United States Patent [19]

Oppenheim et al.

[11] 4,155,752

[45] May 22, 1979

[54] CORROSION-RESISTANT FERRITIC CHROME-MOLYBDENUM-NICKEL STEEL

[75] Inventors: Rudolf Oppenheim; Heinrich Kiesheyer; Helmut Brandis; Gustav Lennartz; Rainer Thielmann, all of Krefeld, Fed. Rep. of Germany

[73] Assignee: Thyssen Edelstahlwerke AG, Krefeld, Fed. Rep. of Germany

[21] Appl. No.: 868,444

[22] Filed: Jan. 10, 1978

[30] Foreign Application Priority Data

Jan. 14, 1977 [DE] Fed. Rep. of Germany ..... 2701329

[51] Int. Cl.[2] ..... C22C 38/06; C22C 38/48; C22C 38/50

[52] U.S. Cl. ..... 75/124; 75/125; 75/128 G; 75/128 N; 75/128 Z; 75/128 T; 75/128 W; 148/37

[58] Field of Search ..... 75/124, 125, 128 C, 75/128 E, 128 F, 128 G, 128 N, 128 W, 128 T, 128 Z; 148/37

[56] References Cited

U.S. PATENT DOCUMENTS

| | | | |
|---|---|---|---|
| 3,856,515 | 12/1974 | Brandis et al. | 75/125 |
| 3,890,143 | 6/1975 | Skoglund et al. | 75/125 |
| 3,929,473 | 12/1975 | Streicher | 75/128 N |
| 3,957,544 | 5/1976 | Pinnow et al. | 75/125 |
| 3,963,532 | 6/1976 | Demo, Jr. | 148/37 |
| 3,992,198 | 11/1976 | Demo, Jr. | 148/37 |
| 4,010,049 | 3/1977 | Rarey | 75/126 F |
| 4,055,448 | 10/1977 | Fujikura et al. | 75/128 N |
| 4,059,440 | 11/1977 | Takemura et al. | 75/126 F |
| 4,101,347 | 7/1978 | Fujikura et al. | 75/125 |
| 4,119,765 | 10/1978 | Pinnow et al. | 75/128 N |

FOREIGN PATENT DOCUMENTS

| | | |
|---|---|---|
| 974555 | 7/1949 | Fed. Rep. of Germany. |
| 2124391 | 9/1976 | Fed. Rep. of Germany. |
| 2153186 | 5/1973 | Fed. Rep. of Germany. |

OTHER PUBLICATIONS

"Tew Technische Berichte", 2, (1976), pp. 3–13, Brandis et al.

"Neue Hatte", 18, (1973), pp. 693–699; Colombie et al.

*Primary Examiner*—Arthur J. Steiner

*Attorney, Agent, or Firm*—Kenyon & Kenyon, Reilly, Carr & Chapin

[57] ABSTRACT

Described herein is a ferritic chrome-molybdenum-nickel steel, containing specified amounts of niobium, zirconium and aluminum, of high chemical resistance against general and intercrystalline corrosion attack, as well as against pitting, crevice and stress corrosion in chloride-containing solutions. The described steel is useful for the fabrication of articles which must exhibit a 0.2-limit of at least 520 N/mm$^2$ at room temperature; a notched bar impact strength of at least 40 J at 0° C and at least 70 J at 20° C in 3-mm U-notch impact specimens; and guaranteed for flat stock such as sheet or strip material up to at least 10 mm thickness and for bar material of at least 60 mm diameter, round of square.

13 Claims, No Drawings

CORROSION-RESISTANT FERRITIC CHROME-MOLYBDENUM-NICKEL STEEL

BACKGROUND OF THE INVENTION

The present invention relates to steel, and more particularly, to a ferritic chrome-molybdenum-nickel steel of high chemical resistance against general and intercrystalline corrosion attack, as well as against pitting, crevice and stress corrosion in chloride-containing solutions.

In contrast to the austenitic chrome-nickel-molybdenum steels as the standard materials for the construction of chemical apparatus, it is well-known that highly alloyed chrome-molybdenum steels possess good resistance against general corrosion attack as well as against intercrystalline, crevice and pitting corrosion, and also possess the substantial advantage of excellent resistance against stress corrosion, particularly in chloride-rich and hot solutions.

Equally well known as disadvantages of the conventional ferritic steels, however, are their cold brittleness and their unsatisfactory welding properties.

Although the carbon and nitrogen content of such steels could be reduced to the required low values of less than 0.01% for the first time at the beginning of the 1950's, and the cause of cold brittleness and welding difficulties eliminated by means of the then developing vacuum melting technology, further advances in vacuum metallurgy up to about the end of the 1960's still did not lead to any appreciable volume of production of such decisively improved ferritic steels.

With the development of the new oxygen refining processes for steel melting, worldwide interest in such cold-tough weldable steels has increased steadily since the beginning of the 1970's, enhanced by the ever more urgent demand for chloride-resistant materials, and thereby also the number of new steels that became known. The present state of the art for this new group of materials, the "superferrites", has been presented in "TEW Technische Berichte" (TEW Technical Reports), 2 (1976), pages 3 to 13.

Depending on the desired corrosion properties, the following chrome-molybdenum-(nickel) steels have been mentioned so far in the literature and in patents or patent applications: 18–20/2–3 CrMo; 20/5 CrMo; 26/1 CrMo; 25/4/4 CrMoNi; 28/2 CrMo and 28/2/4 CrMoNi; 29/4 CrMo and 29/4/2 CrMoNi; and 30/2 CrMo.

Depending upon the melting process employed, different low carbon and nitrogen contents are obtained which, on the one hand, affect the cold-strength and the resistance to intercrystalline corrosion (IK) decisively, but, on the other hand, also determine and increase the production costs.

With high chromium contents, total carbon and nitrogen contents of less than or close to 0.01% can be achieved only with elaborate vacuum melting methods, e.g., in an induction furnace or an electron beam cold-hearth furnace. Nickel-free steels melted in this manner need no stabilizing additives of niobium, titanium or the like to ensure IK resistance.

If the more cost-effective melting processes such as VOD (vacuum oxygen refining) and AOD (argon oxygen refining) or their modifications are used, one must tolerate, however, definitely higher carbon and nitrogen contents, depending upon the chromium alloying level. In steels of this type with carbon and nitrogen contents higher than about 0.01%, additions of titanium, niobium or zirconium must be provided against the danger of intercrystalline corrosion; however, the detrimental effect of the increased carbon and nitrogen contents on the cold-toughness properties can be compensated only partially. In a known manner this "stabilization" by means of titanium or niobium brings about a largely stable binding and thereby renders harmless the carbon and nitrogen contents, such that resistance against intercrystalline corrosion, particularly also in the high-temperature zone near welded seams, can be assured without heat treatment.

The possibility of binding the detrimental nitrogen content by the addition of aluminum and thereby improve the cold strength is also known (German Pat. No. 974,555). In addition, an improvement of the resistance against intercrystalline corrosion by the "stable" binding of increased nitrogen contents has been reported in the literature; "Neue Heutte", 18 (1973), pages 693 to 699.

Among the chrome-molybdenum alloy types 25/4, 28/2 and 29/4, variants with additional nickel contents of 2 and 4%, respectively, have become known, whereby the corrosion-chemical behavior was improved considerably and, in addition, the cold-toughness properties were also influenced favorably.

Summarizing the state of the art described in the literature including the pertinent patent literature, highly alloyed ferritic chrome and chrome-molybdenum steels with good mechanical-technological as well as corrosion-chemical properties can contain higher carbon and nitrogen contents with a total above about 0.01% only if these detrimental higher contents are bound stably by additions of titanium, niobium, zirconium or the like and, in the case of nitrogen, also by aluminum, and sufficient cold-strength is ensured, possibly, by a limited further addition of nickel.

In this direction, the steel X 1 CrNiMoNb 28 4 2 (Material No. 1.4575) which is produced on a large scale, is characteristic of the latest state of the art. This steel is a further development of the highly purified vacuum steel X 1 CrMo 28 2 (Material No. 1.4133; see German Offenlegungsschrift 21 53 186), and contains, with about 28% Cr, 2% Mo and 4% Ni, a stabilizing addition of niobium and a total of up to 0.04% carbon and nitrogen.

Complying with a melting specification in this steel 1.4575 of 0.04% (C + N) maximum in large-scale melting, for example, by the VOD process (vacuum oxygen refining), is, however, quite difficult. In addition it has been found that with a chemical composition of this steel with 0.015% maximum C and 0.035% maximum N, or a total of 0.04% maximum (C + N), a limit, not recognized and described in the literature to date, is reached where the niobium content, matched to the carbon and nitrogen contents for steel, for example, with the alloy base CrMiNoNb 28 4 2, cannot be increased further without basic welding problems, and specifically for the reason that the flexibility and elongation of welded joints are made drastically worse in this case.

SUMMARY OF THE INVENTION

It is therefore an object of the present invention to improve steels of the type described as to their chemical composition in such a manner that with higher carbon and nitrogen contents, i.e., above 0.04% (C + N), no degradation of the welding properties occurs and in addition, all other good mechanical-technological as well as corrosion-chemical properties do not deteriorate decisively.

For the above-mentioned purpose a steel is prepared according to the present invention comprising

| | | | |
|---|---|---|---|
| 18 | to | 32 | % chromium |
| 0.1 | to | 6 | % molybdenum |
| 0.5 | to | 5 | % nickel |
| 0.01 | to | 0.05 | % carbon |
| 0.02 | to | 0.08 | % nitrogen |
| 0.10 | to | 0.60 | % niobium |
| 0.005 | to | 0.50 | % zirconium |
| 0.01 | to | 0.25 | % aluminum |
| up | to | 0.25 | % titanium |
| up | to | 3 | % copper |
| up | to | 3 | % silicon |
| up | to | 1 | % manganese |
| up | to | 0.01 | % each calcium, magnesium, cerium or cerium mixed metal, boron |
| | | | remainder iron and impurities due to the melting process. |

As further requirements, the niobium content must be at least 12-times the carbon content but not more than 12-times plus 0.20%, and the total of the zirconium content and 3.5-times the aluminum content corresponds to at least 10-times of the free, non-niobium-bound nitrogen content, and not more than 10-times plus 0.10% according to the formula:

$$\% \text{ Zr} + 3.5\,(\% \text{ Al}) \geqq 10\left[\% \text{ N} - \frac{\% \text{ Nb} - 10(\% \text{C})}{8}\right]$$

$$\leqq 10\left[\% \text{ N} - \frac{\% \text{ Nb} - 10(\% \text{C})}{8}\right] + 0.10\%$$

Steels of this composition have high 0.2-limits of at least 520 N/mm$^2$ at 20° C. and a notched bar impact strength (DVM, German Society for Testing Materials) of at least 40 J at 0° C. and 70 J at 20° C., applicable to flat stock (sheet, strip) of up to at least 10 mm wall thickness and for bar material up to at least 60 mm diameter, round or square.

Except where otherwise indicated, all percents utilized herein are weight percents.

DETAILED DESCRIPTION OF THE INVENTION

The differences between the present invention and the state of the art described in the following are best explained with reference to Tables 1 and 2. Table 1 contains the analyses and Table 2 the properties of two groups of known steels, Nos. 1 to 8 and Nos. 9 to 14, and of a group of steels to be used in accordance with the present invention, Nos. 15 to 19. Steel Nos. 1 to 8 in Table 1, having the properties noted in Table 2 are known from the German Auslegeschrift 2124391. From this Auslegeschrift, the use of steel with less than 0.06% C, 20 to 35% Cr, less than 8% Ni, 1.0 to 5.0% Mo and 0.3 to 1.5% Nb is known as a material for fabricating structural parts which are resistant to pitting in an environment containing chlorine ions. Preferentially mentioned is 0.5 to 1.0% Nb, by which at least one of the elements zirconium or titanium in the (same) range of 0.3 to 1.5% can be replaced. The greatest effect, however, should be attainable with niobium alone or with niobium-containing combinations of the three elements (German Auslegeschrift 2124391, column 4, lines 53 to 63). No statements or specifications are given regarding matching the niobium content to the carbon content and, particularly, the always present nitrogen content, which is generally known to be an absolutely necessary condition for resistance to intercrystalline corrosion. Contrary thereto, the danger of intercrystalline corrosion is precluded with the steel to be used according to the present invention by unequivocally taking into consideration not only the carbon content but also the nitrogen content. The German Auslegeschrift 2124391 does not recognize the compelling need for an upward limitation of the niobium and zirconium content which has been found to be of extremely great importance in view of the suitability for welding, and thereby of the technical usability, of such steels.

Due to understabilization, steels No. 3, 5 and also No. 7 show first signs of intercrystalline corrosion after quenching from 1200° C. in water or in the high-temperature zone near welded seams with increasing weight losses between the first and the fifth 48-hour boiling in 65% nitric acid (Huey test) or with measurable grain boundary attack between 20 and 30 μm depth. The test results in Table 2 document further the finding, which is of decisive importance for the technical significance of the present invention, that with niobium contents above about 0.60%, the bendability and therefore, also the elongation of welded joints is lost to such an extent that with only a slightly higher niobium content of 0.65% for steel No. 5, the bending angle to fracture in the high-temperature zone near the weld has dropped, due to eutectic-incipient melting, from more than 90° to only 10° and that with 0.70% Nb in steel No. 6 the bendability has practically been lost completely.

In the steel to be used according to this invention, zirconium is added not for binding carbon but is matched exclusively to the nitrogen content present in accordance with the established dosing rules, which are not even mentioned in the German Auslegeschrift 2124391. In the German Auslegeschrift 2124391 is also missing, incidentally, any reference to the possibility of using, besides zirconium, additions of aluminum for binding nitrogen, as is characteristic for the steel to be used according to this invention.

The advantageous effect of aluminum additions in highly alloyed ferritic chrome or chrome-molybdenum steels is basically known per se. Thus, according to the German Pat. No. 974,555, an addition of 0.25 to 1.5% aluminum in steels with at most 0.03% C, at most 0.08% N and at least 0.06% (C + N) with 20 to 30% Cr, 0 to 3% Mo (nickel addition not mentioned) serves to improve the notched bar impact strength at room temperature. On the other hand, however, it is also stated that with carbon contents above 0.03% C no striking effect regarding improved cold toughness can be attributed to the claimed aluminum addition. Thus, this patent does not suggest the use of additions of aluminum together with increased carbon contents or more than 0.03% C.

On the other hand, M. A. Colombie, A. Condylis, R. Desestret, R. Grand and R. Mayoud, in "Neue Huette", 18 (1973), pages 693 to 699, have investigated the targeted nitrogen-binding effect of aluminum in chrome-molybdenum steels especially of the 26/1 type, but also of 28/2 and 22/1 types, with aluminum additions of, for example, about 0.20 to 0.80% for binding, for example, 0.04 to 0.06% N with respect to its action on the resistance against intercrystalline corrosion. Among other things, these authors come to the conclusion that the suppression of the unfavorable, i.e., cold-brittleness-increasing, effect of the nitrogen by aluminum additions permits higher carbon contents without deterioration of the ductility (cold toughness). Although this insight regarding the binding of nitrogen by aluminum is basically correct, a very important limitation of the magnitude of the aluminum addition is not recognized (which, incidentally, also has not been described elsewhere) since the effect of the resistance to intercrystalline corrosion was tested only on samples which had been sensitized for several hours, i.e., up to 10 hours, in the temperature range 650° to 450° C., and not at the critical condition of ferritic steels, i.e., in the heat-affected (high-temperature) zone next to welded seams.

As shown by the test results for intercrystalline corrosion in Table 2 on samples of steel No. 9 to No. 14 in Table 1, which are alloyed with aluminum contents above 0.10%, it is in fact possible, in agreement with the statements by Colombie and coworkers, to effectively eliminate the cold brittleness caused not only by increased nitrogen contents, but also in the case of increased carbon contents such as in steels No. 9 and No. 13, by an aluminum addition. However, the resistance to intercrystalline corrosion cannot be ensured by this method of binding nitrogen, particularly in the high-temperature zone of welded joints.

As a second finding important for the technical significance of this invention (besides the necessary limitation of the niobium contents to at most 0.60% Nb), a maximum content of 0.10% Al was thus recognized as the upper permissible alloying limit for an aluminum addition. The partial solubility of the AlN in the high-temperature zone next to welded seams leads, if they are cooled down fast, to precipitation of chromium nitrides on the grain boundaries, and as the secondary consequence thereof, the chromium depletion of the grain boundary regions leads to a locally limited sensitivity to intercrystalline corrosion. This fault phenomenon is not observed in the steels Nos. 15 to 19 in Table 1 and Table 2 according to the invention, with aluminum contents of less than 0.10%.

In view of the literature which represents the known state of the art, in which no unequivocal and effective teachings for technical action can be found or even derived for the manufacture and processing of cold-tough weldable ferritic chrome-molybdenum-nickel steels with increased carbon and nitrogen contents of distinctly more than 0.030% (C + N), the present invention is thus based on the discovery that with carbon and nitrogen contents above about 0.040% (C + N) and in the technically especially interesting range up to at least 0.080% (C + N), the absolutely necessary stable binding of carbon and nitrogen preferably by niobium alone is no longer possible and also not by niobium plus zirconium or niobium plus aluminum. According to the invention, the carbon is therefore bound satisfactorily with at least 12-times the niobium content. The free nitrogen, which is not yet bound by the presence of a niobium excess, is bound by zirconium and aluminum where these supplemental elements mentioned, in addition to their respective matching to the carbon and nitrogen contents, must be limited individually further to at most 0.60% Nb, at most 0.80% (Nb + Zr) and at most 0.10% Al. Only steels alloyed in this manner such as, for example, the steels Nos. 15 to 19 in Table 1 according to the invention meet simultaneously all specified requirements, as compared to steel Nos. 1 to 14 as per Table 1 which are not in accordance with the invention but are largely alloyed similarly. They are resistant to intercrystalline corrosion after quenching from 1200° C. in water (in the Huey test) as well as in the high-temperature zone next to welded joints (in the Streicher test) without heat treatment. Such welded joints are in addition sufficiently bendable and capable of elongation; the 0.2-limit reaches high values of at least 520 $N/mm^2$ at room temperature, and a notched bar impact strength (DVM) of at least 70 J at room temperature and at least 40 J at 0° C. characterizes high cold strength also at low ambient temperatures.

The passivity and, thereby, the corrosion resistance of the steels according to the invention is increased with increasing chromium content in the range of 18 to 32% Cr. With chromium contents of less than 18%, sufficient passivity of the steel cannot yet be obtained for the fields of application according to the invention, and above 32%, no adequate further improvement is achieved.

Through the addition of 0.5 to 6% Mo according to the invention, particularly the resistance to pitting in chloride-containing solutions as well as the passivity under reducing conditions are improved decisively; however, steels with molybdenum contents higher than 6% Mo can practically no longer be manufactured or processed because of structural instability and embrittlement phenomena.

To the steel to be used according to the invention, nickel contents of up to a maximum of 5% are added for improving the cold strength, the strength properties and the corrosion resistance, the upper limit being determined by the incipient formation of austenite in the otherwise purely ferritic steels. The nickel addition improves the chemical resistance particularly under reducing conditions as well as in chloride-containing solutions against crevice corrosion.

As particularly advantageous alloying matches have been found to be steels with about 28% Cr, 2% Mo and 4% Ni as well as with about 20% Cr, 5% Mo and 2% Ni, as these steels can, among other things, be manufactured and processed economically also on a large scale due to still sufficient structural stability.

In the stable binding of the carbon and nitrogen contents it has been found to be advantageous to match the niobium content only to the carbon present and to thereby limit the formation of relatively coarse-grain niobium carbonitrides. With carbon contents of up to about 0.025%, the niobium content can thereby be limited to the preferred addition of 0.30%.

Binding the nitrogen present primarily by zirconium and, in addition also by aluminum up to a maximum of 0.1% Al leads, as a consequence of the small particle size of these special nitrides and thereby of the large number of particles, to a remarkable insensitivity of the steels of this invention to the large-grain embrittlement at high temperatures, which is otherwise feared in ferritic steels, i.e., particularly also in the heat-affected zones next to welded zones.

Because of the limitation of the contents of niobium plus zirconium as well as of aluminum, it may become necessary with very high carbon plus nitrogen contents to supplement or partially replace the aluminum content for binding the nitrogen by adding twice the amount of titanium therefor, i.e., for instance 0.1% Ti instead of 0.05% Al. Because of the adverse effect of titanium additions on the embrittlement behavior of the steel to be used according to the invention in the range of the sigma phase and also on the 475° C. embrittlement as well as in the direction of increased cold brittleness, the titanium addition should, however, be kept to a minimum.

In order to improve the corrosion resistance, up to 3% Cu, and preferably 0.5 to 2%, can be added to the steel to be used according to the invention, whereby the stability in nonoxidizing acids and in particular, in hot sulfuric-acid solutions, is increased. The addition of up to 3% silicon, and preferentially of 0.5 to 2%, improves particularly the resistance of pitting.

To improve the general chemical stability, also a rare metal such as silver, gold or metals of the palladium and platinum group can be added in small amounts, e.g., up to 0.1%, in a manner known per se.

The steel to be used in accordance with the invention finally can further contain small amounts of the elements calcium, cerium or cerium mixed metal, or boron up to 0.1%, as these elements can be added in the course of metallurgical process steps for deoxidation or desulfurization or for improving the behavior in hot conversion as well as in welding.

The proposed steel can be melted economically on a large scale as well as processed into any semi-finished or finished products, i.e., into slab ingots, wide hot- and cold-rolled strip as well as hot-rolled heavy sheet, into forgings and flat bloom including material for tubes, into bar steel, wire rod, drawn bars as well as wire and finally also into seamless and welded tubes.

The steel can be used to advantage as material for welded articles which are resistant to intercrystalline corrosion after welding without heat treatment and reach in the welded joint uniform elongation of at least 10% without incipient cracks. Another field of application is apparatus, apparatus components, heat exchangers, condensers, valves as well as pressure vessels and pressure vessel components which are subjected to corrosion-chemical attack at room temperature or elevated temperatures, also at elevated pressures. The steel is also suited as material for articles which must be resistant againt pitting, crevice and stress corrosion in solutions with a high chloride content. Other preferred applications are evaporators, piping, pumps or similar parts for sea water desalination plants as well as articles which must withstand the attack of sulfuric acid also at elevated temperatures, and as material for magnetically actuated fittings and valves.

Table 1

| Steel No. | Chemical Composition C | N | (C+N) | Cr | Ni | Mo | Nb | Zr | Al |
|---|---|---|---|---|---|---|---|---|---|
| 1 | 0.008 | 0.019 | 0.027 | 27.6 | 3.49 | 2.05 | 0.43 | n.b. | n.b. |
| 2 | 0.009 | 0.024 | 0.033 | 27.9 | 3.69 | 2.22 | 0.48 | n.b. | n.b. |
| 3 | 0.016 | 0.026 | 0.042 | 28.0 | 3.51 | 1.96 | 0.38 | 0.012 | 0.004 |
| 4 | 0.019 | 0.024 | 0.043 | 28.2 | 3.75 | 2.21 | 0.61 | n.b. | 0.006 |
| 5 | 0.019 | 0.046 | 0.065 | 27.6 | 3.98 | 2.01 | 0.65 | n.b. | 0.004 |
| 6 | 0.024 | 0.032 | 0.056 | 27.4 | 3.66 | 2.14 | 0.70 | 0.006 | 0.015 |
| 7 | 0.030 | 0.045 | 0.075 | 27.9 | 3.95 | 1.98 | 0.95 | n.b. | 0.004 |
| 8 | 0.014 | 0.048 | 0.062 | 28.0 | 3.67 | 2.15 | 0.76 | 0.12 | n.b. |
| 9 | 0.024 | 0.042 | 0.066 | 28.0 | 3.68 | 2.20 | 0.33 | 0.008 | 0.13 |
| 10 | 0.012 | 0.043 | 0.055 | 27.8 | 3.99 | 2.00 | 0.20 | n.b. | 0.25 |
| 11 | 0.018 | 0.043 | 0.061 | 28.3 | — | 1.99 | 0.19 | n.b. | 0.24 |
| 12 | 0.014 | 0.041 | 0.055 | 28.2 | 3.68 | 2.15 | 0.28 | 0.12 | 0.16 |
| 13 | 0.021 | 0.039 | 0.060 | 28.0 | 3.68 | 2.14 | 0.24 | 0.14 | 0.15 |
| 14 | 0.014 | 0.037 | 0.051 | 27.6 | 3.72 | 2.26 | 0.02 | 0.36 | 0.22 |
| 15 | 0.018 | 0.021 | 0.039 | 27.8 | 4.03 | 2.03 | 0.53 | 0.02 | 0.03 |
| 16 | 0.017 | 0.026 | 0.043 | 27.9 | 3.59 | 1.99 | 0.39 | 0.05 | 0.02 |
| 17 | 0.015 | 0.a038 | 0.053 | 28.0 | 3.69 | 2.10 | 0.36 | 0.26 | 0.03 |
| 18 | 0.019 | 0.041 | 0.060 | 27.9 | 3.69 | 2.15 | 0.51 | 0.10 | 0.03 |
| 19 | 0.029 | 0.042 | 0.071 | 28.1 | 3.71 | 2.03 | 0.48 | 0.14 | 0.05 |

Table 2

| Steel No. | Properties of the Steels as per Table 1: IK Resistance Huey (1) | 1200° /W) (g/m²h) | IK (2) | Weld Sample Streicher/ Flex. Angle (3) | (4) | 0.2-Limit (N/mm²) | Notch Impact Work (DVM (J) at °C.): −25° | −15° | ±0° | +25° |
|---|---|---|---|---|---|---|---|---|---|---|
| 1 | 0 | | n.b. | <5 μm | >90° | 565 | 15; 16; 17 | 28; 30; 30 | 100; 104; 104 | 149; 158 |
| 2 | | | n.b. | n.b. | >90° | 585 | 9; 32; 45 | 56; 86; 88 | 70; 87; 117 | 94; 104; 115 |
| 3 | 1 | (0.11/0.25) | 30 μm | n.b. | >90° | 519 | 26; 30; 36 | 58; 63; | 85; 93; 120 | 148; 157 |
| 4 | 0 | | n.b. | n.b. | ~90° | 566 | 14; 23; 28 | 11; 40; 45 | 55; 58; 64 | 67; 72; 83 |
| 5 | 0 | (0.10/0.12) | 26 μm | n.b. | ~10° | 519 | 6; 7; 8 | n.b. | 31; 35; 36 | 78; 97 |
| 6 | 0 | | n.b. | < 5 | < 5° | 559 | 18; 23; 26 | 19; 23; 26 | 39; 47; 63 | 68; 75; 91 |
| 7 | 1 | (0.14/0.30) | 22 μm | n.b. | < 5° | 509 | 6; 6; 6 | n.b. | 12; 15; 19 | 75; 91 |
| 8 | 0 | (0.09/0.18) | n.b. | n.b. | ~6° | 545 | n.b. | n.b. | n.b. | n.b. |
| 9 | 1 | (0.06/0.25) | n.b. | 75 | >90° | 603 | 18; 24; 65 | 35; 80; 88 | 100; 102; 122 | 128; 136 |
| 10 | 1-2 | (0.10/0.14) | 90 μm | n.b. | >90° | 518 | 30; 48; 49 | n.b. | 83; 85; 92 | 81; 99 |
| 11 | 2 | (0.90/1.2) | 110 μm | n.b. | >90° | 351 | 7; 8; 62 | n.b. | 38; 76; 92 | 72; 74 |
| 12 | 1-2 | (0.12/0.53) | n.b. | n.b. | >90° | 585 | 57; 74; 87 | n.b. | 91; 100; 103 | 99; 112 |
| 13 | 1 | (0.07/0.22) | n.b. | 80 | >90° | 573 | 22; 26; 28 | 33; 38; 44 | 34; 68; 70 | 89; 93; 93 |
| 14 | 2 | (0.07/0.43) | n.b. | 330 | >90° | 571 | 18; 19; 22 | 22; 26; 32 | 58; 58; 63 | 88; 101; 104 |
| 15 | 0 | | n.b. | n.b. | >90° | 523 | 76; 85; 86 | n.b. | 105; 108; 120 | 146; 151 |
| 16 | 0 | | n.b. | n.b. | >90° | 529 | 24; 27; 32 | n.b. | 73; 80; 91 | 103; 114 |
| 17 | 0 | (0.07/0.13) | n.b. | 9 μm | >90° | 569 | 17; 18; 20 | 18; 27; 29 | 44; 56; 61 | 89; 91; 91 |
| 18 | 0 | | n.b. | n.b. | >90° | 530 | n.b. | n.b. | 50; 53; 62 | 71; 73; 84 |

Table 2-continued

| Steel No. | IK Resistance Huey (1) | 1200° /W) (g/m²h) | IK (2) | Properties of the Steels as per Table 1: Weld Sample Streicher/ Flex. Angle (3) | (4) | 0.2-Limit (N/mm²) | Notch Impact Work (DVM (J) at °C.): −25° | −15° | ±0° | +25° |
|---|---|---|---|---|---|---|---|---|---|---|
| 19 | 0 | | n.b. | 12 μm | >90° | 563 | 10; 12; 23 | n.b. | 42; 51; 57 | 71; 75 |

(1) Intercrystalline corrosion (IK) sensitivity in the Huey test: 0 = no sensitivity; 1 = slight sensitivity; 2 = medium sensitivity
(2) IK sensitivity in the Huey test: depth of penetration in μm
(3) IK sensitivity in the Streicher test (heat-affected zone): depth of penetration in μm
(4) Bending angle of welded joints, without heat treatment, bent to fracture (D = 2 × sheet thickness; sheet thickness 3 to 12 mm)

What is claimed is:

1. A ferritic chrome-molybdenum-nickel steel of high chemical resistance against general and intercrystalline corrosion attack as well as against pitting, crevice and stress corrosion in chloride-containing solutions consisting essentially of:

| | | | |
|---|---|---|---|
| 18 | to | 32 | % chromium |
| 0.1 | to | 6 | % molybdenum |
| 0.5 | to | 5 | % nickel |
| 0.01 | to | 0.05 | % carbon |
| 0.02 | to | 0.08 | % nitrogen |
| 0.10 | to | 0.60 | % niobium |
| 0.005 | to | 0.50 | % zirconium |
| 0.01 | to | 0.25 | % aluminum |
| up | to | 0.25 | % titanium |
| up | to | 3 | % copper |
| up | to | 3 | % silicon |
| up | to | 1 | % manganese |
| up | to | 0.01 | % each calcium, magnesium, cerium or cerium mixed metal, boron |
| | | | remainder iron and impurities due to the melting process. |

wherein the niobium content is at least 12-times that of the carbon and at most 12-times + 0.20%, and the total content of zirconium plus 3.5-times the aluminum content at least 10-times that of the free, non-niobium-bound nitrogen content and at most 10-times + 10% according to the formula:

$$\% Zr + 3.5 (\% Al) \geqq 10 \left[ \% N - \frac{\% Nb - 10(\%C)}{8} \right]$$

-continued $$\leqq 10 \left[ \% N - \frac{\% Nb - 10(\%C)}{8} \right] + 0.10\%$$

2. A steel according to claim 1 containing about 27.5 to 29% chromium, 1.8 to 2.5% molybdenum, and 3.3 to 4.0% nickel.

3. A steel according to claim 1 containing about 19.5 to 21% chromium, 4.0 to 5.0% molybdenum, and 1.5 to 2.5% nickel.

4. A steel according to claim 1 in which the total carbon and nitrogen contents are at most 0.080%.

5. A steel according to claim 1 containing from about 0.15 to 0.45% niobium.

6. A steel according to claim 5 containing no greater than about 0.30% niobium.

7. A steel according to claim 1 containing no greater than about 0.10% aluminum.

8. A steel according to claim 1 containing no greater than about 0.80% combined content of niobium and zirconium.

9. A steel according to claim 1 wherein said aluminum is partially replaced by about twice the amount of titanium, but only up to 0.25% titanium.

10. A steel according to claim 1 containing from about 0.5 to about 2.0% copper.

11. A steel according to claim 1 containing from about 0.5 to about 2.0% silicon.

12. A process for the manufacture of articles which must exhibit a 0.2-limit at room temperature of at least 520 N/mm², a notched bar impact strength of at least 40 J at 0° C. and at least 70 J at 20° C. on DVM specimens, and guaranteed for flat stock such as sheet or strip up to at least 60 mm diameter, round or square, comprising fabricating said articles from a steel according to claim 1.

13. Articles manufactured in accordance with claim 12.

* * * * *